US006016670A

United States Patent [19]

Kuhrau et al.

[11] Patent Number: 6,016,670

[45] Date of Patent: Jan. 25, 2000

[54] CIRCULAR KNITTING MACHINE HAVING A CONSTANT TAKEDOWN ASSEMBLY

[75] Inventors: Michael K. Kuhrau, Orangeburg, S.C.; John Cecil Knight, Sr., Jamesville, Wis.; Donald Charles Fosselman, Orangeburg, S.C.

[73] Assignee: Mayer Industries, Inc., Orangeburg, S.C.

[21] Appl. No.: 08/901,571

[22] Filed: Jul. 28, 1997

[51] Int. Cl.[7] ..... D04B 15/88

[52] U.S. Cl. ..... 66/152; 66/151; 66/153; 66/9 B

[58] Field of Search ..... 66/152, 153, 151, 66/9 B

[56] References Cited

U.S. PATENT DOCUMENTS

| | | | |
|---|---|---|---|
| 2,586,470 | 2/1952 | Lawson . | |
| 2,621,500 | 12/1952 | Clentimack . | |
| 3,695,062 | 10/1972 | Schaack | 66/151 |
| 3,760,609 | 9/1973 | Poocza et al. . | |
| 3,850,012 | 11/1974 | Bourgeois | 66/151 |
| 3,999,405 | 12/1976 | Abler et al. | 66/9 B |
| 4,028,912 | 6/1977 | Schneck . | |
| 4,236,390 | 12/1980 | Blank et al. . | |
| 4,549,412 | 10/1985 | Stoll et al. . | |
| 4,671,083 | 6/1987 | Sawazaki et al. | 66/151 |
| 4,790,152 | 12/1988 | Geitner . | |
| 4,879,886 | 11/1989 | Okada et al. . | |
| 4,969,340 | 11/1990 | Brega . | |
| 5,133,197 | 7/1992 | Shima et al. . | |
| 5,381,676 | 1/1995 | Shibata et al. . | |
| 5,537,845 | 7/1996 | Lin . | |

FOREIGN PATENT DOCUMENTS

| | | |
|---|---|---|
| 1481295 | 5/1989 | U.S.S.R. . |
| 1758107 | 8/1992 | U.S.S.R. . |

OTHER PUBLICATIONS

Manual for Mayer Industries' 18HP/SMM machine, 1984, 2 pages.

*Primary Examiner*—Andy Falik
*Attorney, Agent, or Firm*—Alston & Bird LLP

[57] ABSTRACT

A circular knitting machine including a takedown assembly for applying constant tension to the formed knitted fabric. The circular knitting machine includes a rotating knitting cylinder, a takedown assembly, and a fabric receiving tub. The takedown assembly and the knitting cylinder rotate synchronously. A vertical shaft associated with a motor cooperates with a cylinder ring gear of the knitting cylinder and a takedown ring gear of the takedown assembly. A drive unit including a drive assembly and a clutch assembly is mounted to the takedown ring gear. The clutch assembly includes a drive gear which cooperates with the stationary ring gear of the fabric receiving tub to transmit toque to the rollers of the roller assembly.

21 Claims, 7 Drawing Sheets

CIRCULAR KNITTING MACHINE HAVING A CONSTANT TAKEDOWN ASSEMBLY

CROSS-REFERENCE TO RELATED APPLICATIONS

This application is related to commonly owned copending Provisional Application Serial No. 60/022,077, filed Jul. 29, 1996, and claims the benefit of its earlier filing date under 35 U.S.C. 119(e).

FIELD OF THE INVENTION

The invention relates to a circular knitting machine having a takedown assembly which is driven by a takedown ring gear wherein the rollers of the takedown assembly are driven by a drive unit associated with a clutch assembly so as to provide constant and even pull on the knitted fabric.

BACKGROUND OF THE INVENTION

Circular knitting machines generally include rotating cylinders and knitting assemblies for forming tubular knitted fabric. Some such machines also include means for feeding sliver to the knitting assembly. The knitting assemblies include an upper and main bed for forming the tubular knitted fabric. The knitted fabric is delivered in a hanging condition from the main bed and rotates with the cylinder. A takedown assembly is often positioned beneath the knitting assembly to pull the knitted fabric from the cylinder and to flatten the tubular fabric. The takedown assembly thereby rotates synchronously with the cylinder to avoid twisting the fabric as it rotates with the cylinder. The takedown assembly generally includes a plurality of rollers wherein the knitted fabric is fed between the driven rollers so as to apply a preset tension to the fabric. Problems occur, however, because the desired tension on the formed fabric from the takedown assembly may vary due to different stitch construction, different types of yarn, variations in stitch lengths performed, etc. If too much tension is applied to the fabric, the fabric may become torn or the knitting needles may be sufficiently stressed wherein breakage occurs. Accurate control of the tension applied to the fabric as it is processed is fundamental to maintaining high fabric quality.

Prior art attempts of adjusting the torque of the rollers responsive to the tension of the fabric include systems utilizing weights and counterweights. The rollers of such units swivel or rock about a pivot to adjust for the tension in the fabric. As a result, the fabric may be taken down unevenly in that one side of the fabric, is pulled faster than the opposite side. In addition, the fabric is not pulled at a constant tension which occasionally results in the fabric getting stretched and/or torn.

In an attempt to overcome these problems, efforts have been made to keep the rollers of the takedown assembly in a level (rather than allowing it to rock back and forth) position. This has been attempted by controlling the speed of the rollers by means of two adjustable pulleys. The pulleys are each adjustably rotatable to adjust the external diameter of the pulley to thereby vary the speed of rotation thereof relative to the other pulley so that the rollers takedown the fabric more evenly. Unfortunately, this has been only moderately successful and has resulted in excessive wear on the pulley belts which requires constant replacement.

It has also been proposed, such as in U.S. Pat. No. 5,537,845 to Lin, to provide a motor, separate from the motor driving the cylinder and knitting assembly, for applying torque to the rollers of the takedown assembly. That patent is directed to a takedown assembly including a take-up roll for receiving the formed fabric in rolled form. As such, the motor for driving the rollers is adjustable relative to the take-up speed of the take-up roller. According to that patent, the motor is not directly responsive to the tension in the fabric as it is being pulled from the cylinder and the knitting assembly. Additionally, a plurality of motors is required.

U.S. Pat. No. 4,879,886 to Okada et al. is directed to a circular knitting machine including a takedown assembly wherein the knitted fabric is received by a take-up roll. The takedown assembly includes three rollers having a constant torque transmission utilizing magnetic clutches. The takedown rollers depend from and are positioned below the cylinder ring gear and the clutch is positioned on respective ends of a roller thereof. The three rollers include one driver roller and two driven rollers. Torque is applied to the driver roller by a complex arrangement of chains, transmission shafts, bevel gears, pulleys, reduction gears, etc., by a pinion associated with the ring gear. Magnetic clutches are associated with the driven roller wherein if excessive load is transferred to the clutch, slippage occurs.

The takedown assembly according to the '886 patent, however, is in combination with a take-up roll for receiving the knitted fabric in rolled form. It would be impractical for knitting high pile fabrics such as formed by sliver knitting, as discussed below. It is an impractical takedown assembly for a circular knitting machine having a tub for receiving the falling formed fabric. This is because the rollers of the '886 patent extend within the housing of the take-up roll, thereby diminishing its filling capacity. Furthermore, the positioning of the rollers farther from the main bed of the cylinder assembly results in a less effective control of the fabric tension. Additionally, the complex structure of the transmission means for driving the driven roller results in a less effective transmission of torque to the takedown assembly driven by the cylinder ring gear, and multiple clutch systems are used, one on each side of the roller assembly.

SUMMARY OF THE INVENTION

It is an object of the present invention to provide a takedown assembly for a circular knitting machine which effectively utilizes the forces of the rotating cylinder to apply tension to the formed knitted fabric.

It is another object of the present invention to provide a takedown assembly which may be effectively utilized for forming high pile fabric.

These and other objects are achieved by the present invention which overcomes the drawbacks and shortcomings of the prior art. The circular knitting machine according to the present invention includes, generally, sliver feeding means, a knitting assembly having an upper and main bed, and a tub for receiving the knitted fabric. A cylinder ring gear is associated with the cylinder. A drive motor is supported on the frame of the knitting machine and is associated with a vertical drive shaft. The vertical drive shaft includes an upper drive pinion gear which cooperates with the rotating cylinder ring gear. A stationary ring gear circumscribes the upper opening of the tub to the vertical drive shaft. A takedown ring gear is concentrically positioned within the stationary ring gear. The takedown ring gear cooperates with a lower pinion gear mounted to the lower end of the vertical drive shaft. Accordingly, the cylinder ring gear and the takedown ring gear rotate concurrently when the motor is actuated.

A drive unit and a roller assembly are mounted to the takedown ring gear. The drive unit includes a clutch assembly, such as a magnetic clutch, and a drive assembly. The clutch assembly includes a clutch drive gear which cooperates with the stationary ring gear. When the takedown assembly machine is rotated, i.e., when the motor is actuated, the drive gear mounted to the takedown ring gear is geared with the stationary ring gear, thereby driving the clutch assembly. Thus, the clutch assembly turns at a predetermined rpm relative to the rpm of the knitting machine.

The rotation of the clutch drive gear causes a shaft of the clutch assembly to rotate. As the clutch assembly rotates, a pulley mounted on top of the assembly rotates, in turn causing a belt positioned thereon to also rotate. The opposite end of the belt turns a worm gear of the drive assembly causing at least one of the takedown rollers to turn on its respective shaft. The worm gear meshes with a roller drive gear mounted on an end of one of the rollers thereby transmitting torque to the driver roller. The driver roller, in turn, drives the second or driven roller.

The clutch assembly has an adjustable torque range, which when adjusted up or down, allows the takedown assembly to either allow a hard pull on a thick and/or strong fabric or pull lightly on a thin and/or weak fabric at an even and constant rate to minimize stretching and tearing, thereby ensuring a quality fabric. When the predetermined torque setting of the magnetic clutch is exceeded, the clutch will begin to slip, thereby reducing tension on the fabric as the takedown rollers continue to pull. The more load applied to the rollers, the more the clutch assembly will slip. The use of the magnetic clutch allows for an even and constant fabric tension, which will in turn provide superior quality and better control of the fabric. With the magnetic clutch, enough torque may be supplied for even the most heavy fabrics, e.g., high pile fabrics, at the maximum production rate, while allowing the takedown unit to run very light weight fabrics at the minimum production rate with very little torque. When the light weight fabrics with minimum production are run, the magnetic clutch will slip, therefore maintaining the proper torque required. An example of a magnetic clutch is produced by Magnetic Technologies LTD, Oxford, Mass.

A further advantage of the present takedown assembly is that speed control of the takedown rollers is avoided because the speed of the rollers is determined by the amount of torque required to safely pull down the fabric being formed. The present invention allows the magnetic clutch to operate at different rotational speeds than the knitting machine. Because there is constant torque on the worm gear of the roller assembly, slipping of the fabric relative to the rollers is limited if not prevented. Consequently, the tension on the fabric will remain constant, thereby limiting or preventing unwanted stretching or tearing of the fabric.

The sliver knitting machine according to the present invention effectively forms and processes knitted fabrics of various weights. To accommodate high pile fabrics, the knitting machine includes a tub receptacle for receiving the knitted fabric. Knitting machines having a spindle type takedown roll for receiving the formed fabric are often impractical, if not inadequate, when high pile fabrics are knitted. For instance, when a high pile fabric is rolled up onto such takedown assemblies, only a relatively small amount of fabric may be received by the roll. Due to the thickness of high pile fabric, a relatively increased diameter of each layer of the fabric around the roll results, diminishing the length of fabric received thereon. This results in frequent operator time in replacing the takedown roll and minimized lengths of knitted fabric per takedown roll. Additionally, wrinkles or folds in the high pile fabric rolled about the roll may diminish the fabric quality. Accordingly, the present invention includes a tub for receiving the formed knit wherein the knitted fabric falls loosely therein. To increase the filling capacity of the tub, the rollers of the takedown assembly according to the present invention are positioned above the takedown ring gear. Additionally, it has been found that the proximity of the takedown rollers to the main bed of the knitting assembly results in better control of tension on the formed knitted fabric.

BRIEF DESCRIPTION OF THE DRAWINGS

The foregoing and other objects, features, and advantages of the present invention will be made apparent from the following detailed description of the preferred embodiment of the invention and from the drawings, in which.

DETAILED DESCRIPTION OF THE PREFERRED EMBODIMENTS

Figure 1:
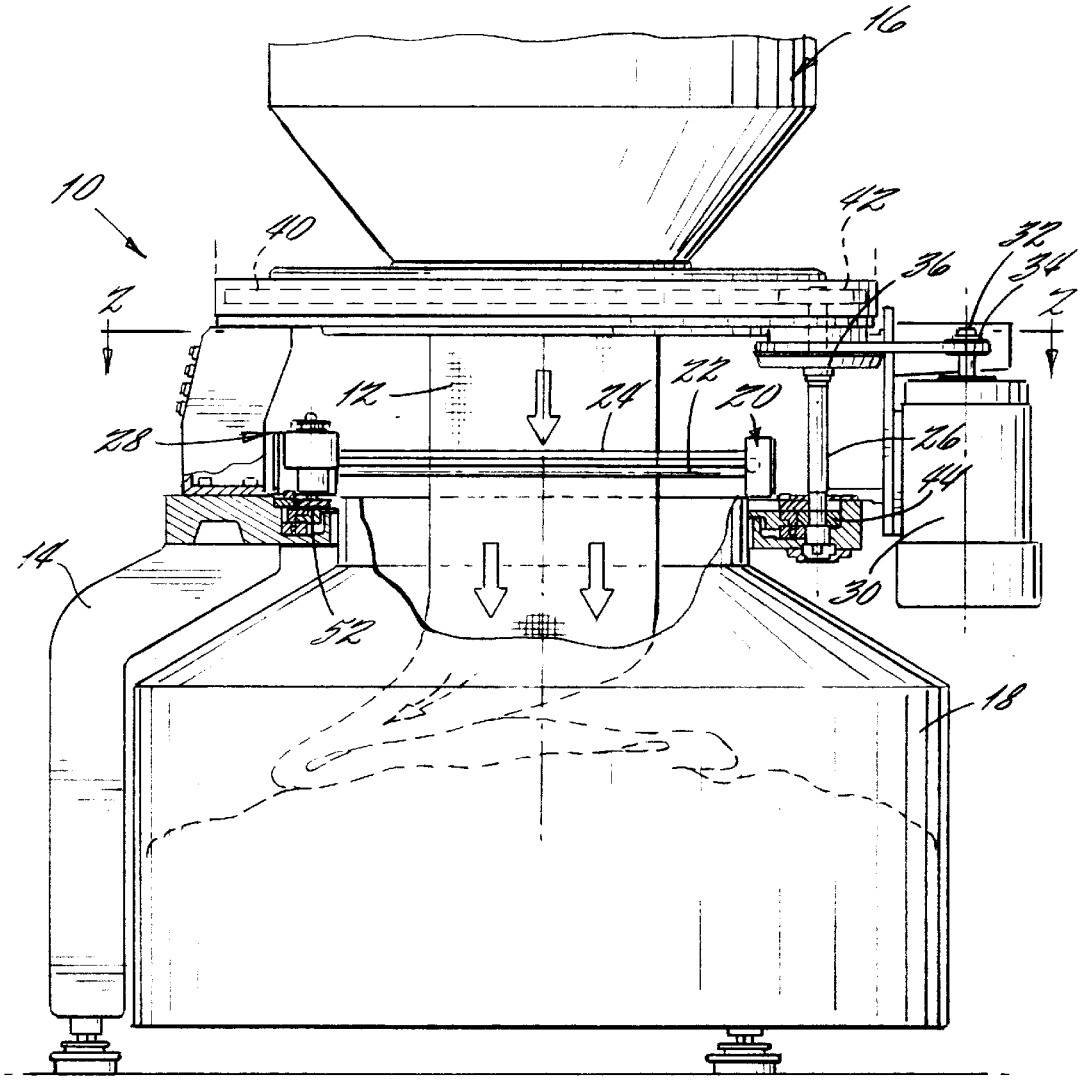
FIG. 1 is a perspective view, partially broken away, of a circular knitting machine according to the present invention.

The present invention will now be described more fully in detail with reference to the accompanying drawings, in which preferred embodiments of the invention are shown. This invention should not, however, be construed as limited to the embodiments set forth herein; rather, they are provided so that this disclosure will be thorough and complete and will fully convey the scope of the invention to those skilled in the art.

The present invention is directed to a circular knitting machine, indicated generally at 10, for forming knitted fabric 12 of various weights. The circular knitting machine 10 includes a frame 14 for supporting a rotating cylinder, indicated generally at 16, and a fabric receiving tub 18.

The rotating cylinder 16 includes a knitting assembly (not shown) having an upper needle bed and a main bed for forming the tubular knitted fabric 12. The tubular knitted fabric 12 is delivered from the rotating cylinder 16 in a hanging state and is pulled down therefrom by a takedown assembly shown generally at 20. The takedown assembly 20 includes a plurality of rollers 24, two of which are shown, wherein the formed tubular knitted fabric 12 is received between the rollers 24. The rollers rotate inwardly in opposing directions to draw the fabric from the rotating cylinder 16. The fabric receiving tub 18 defines the area for receiving the formed fabric and includes a fabric receiving aperture 46 at its upper end. The fabric receiving aperture is defined by an internal gear hereinafter referred to as a stationary ring gear 48. As the tubular knitted fabric 12 is pressed between the rollers 24, it becomes flattened wherein the flattened knitted fabric falls in a cascading fashion within the fabric receiving tub 18.

The rotating cylinder 16 and the takedown assembly 20 rotate synchronously and are connected by a vertical shaft 26. The takedown assembly 20 also includes a drive unit 28 for driving the roller assembly. As is common with circular knitting machines, the cylinder 16 rotates during the production of the knitted fabric. So as not to twist the fabric 12, the takedown assembly 20 likewise rotates at substantially the same rpm as the cylinder 16. The rotational movement is applied to the circular knitting machine 10 by a motor 30. The motor 30 includes a vertical transmission shaft 32 having a pulley 34 mounted adjacent its upper end. The motor 30 is mounted to the frame 14 of the circular knitting machine 10 by an appropriate bracket. Another pulley 36 is mounted adjacent an upper end of the vertical shaft 26 wherein a belt 38 extends around the motor pulley 34 and the vertical shaft pulley 36 to transmit torque from the motor 30 to the vertical shaft 26 upon actuation of the motor.

The rotating cylinder 16 includes a cylinder ring gear 40, shown in phantom in FIG. 1. The cylinder ring gear 40 includes an internal gear which mates with an upper drive pinion gear 42 shown in phantom in FIG. 1. As such, the vertical shaft 26 rotates, the upper drive pinion gear 42 mounted thereon meshes with the cylinder ring gear, and rotational forces are transmitted to the cylinder 16.

Figure 3:
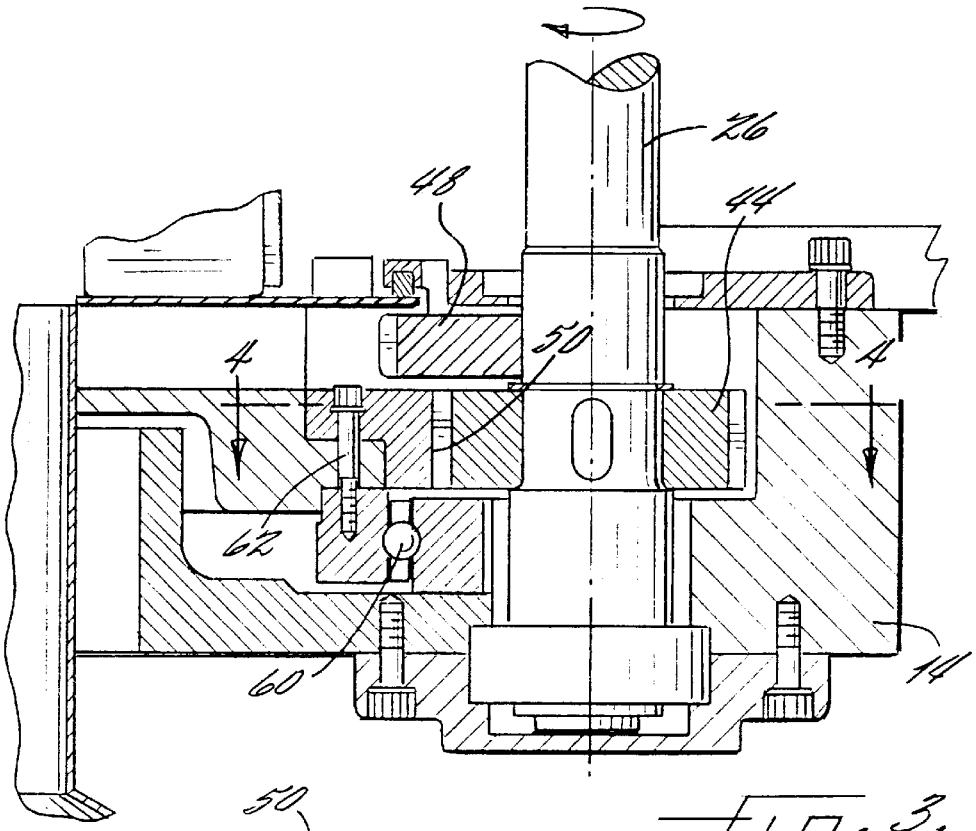
FIG. 3 is an enlarged cross-sectional view of the mechanism driving the takedown ring gear.
Figure 4:
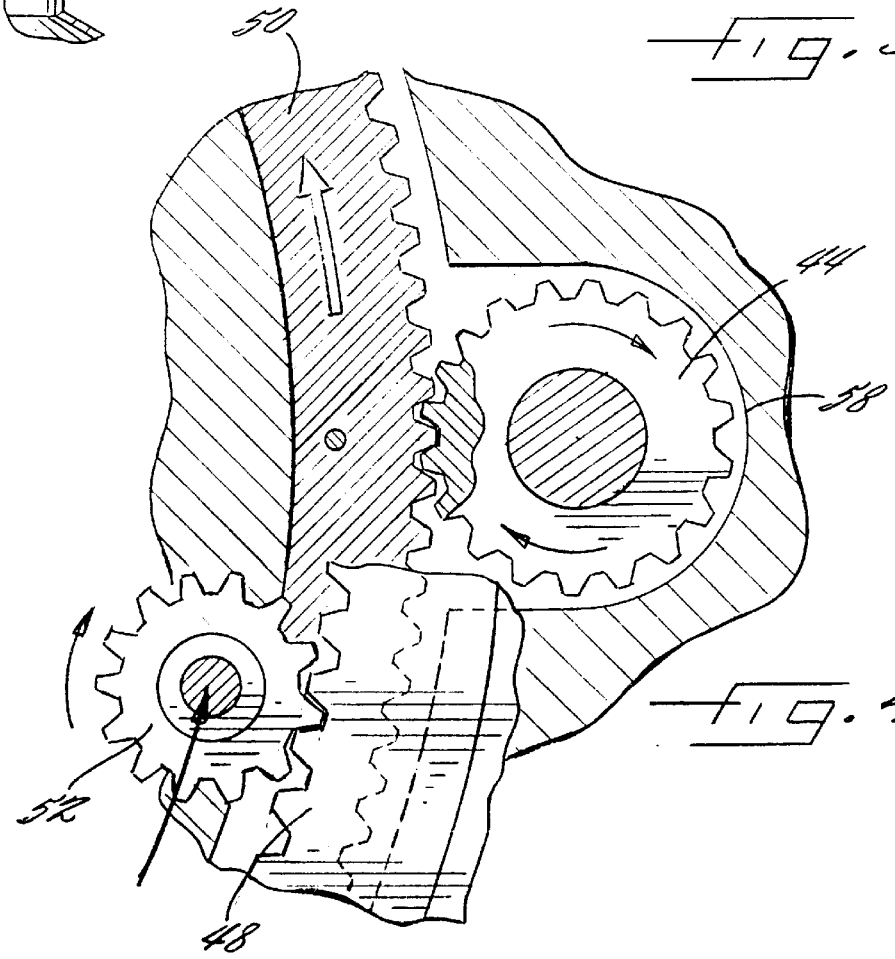
FIG. 4 is an enlarged view taken along line 4—4 of FIG. 3.

The takedown assembly 20 rotates simultaneously with the cylinder 16 due to the connection therebetween via the vertical shaft 26. As best illustrated in FIG. 3, the vertical shaft 26 also supports a lower drive pinion gear 44. The takedown assembly 20 includes a takedown ring gear 50 which meshes with the lower drive pinion gear 44 for rotating the takedown assembly 20. The stationary ring gear 40 cooperates with the drive gear 52 of the drive unit 28 as will be described in more detail below. As best illustrated in FIGS. 3 and 4, the stationary ring gear 48 is positioned above the takedown ring gear 50 wherein the takedown ring gear 50 rotates beneath the stationary ring gear 48.

Figure 5:
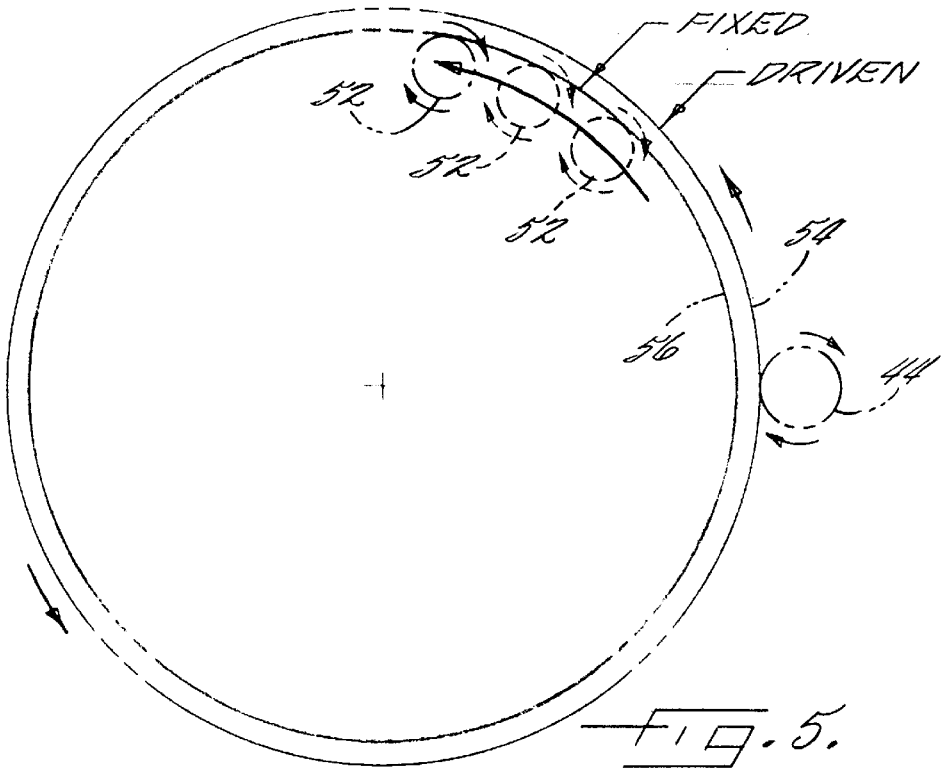
FIG. 5 is a schematic illustration representing the movement of the takedown ring gear and drive gear for the takedown assembly.
Figure 6:
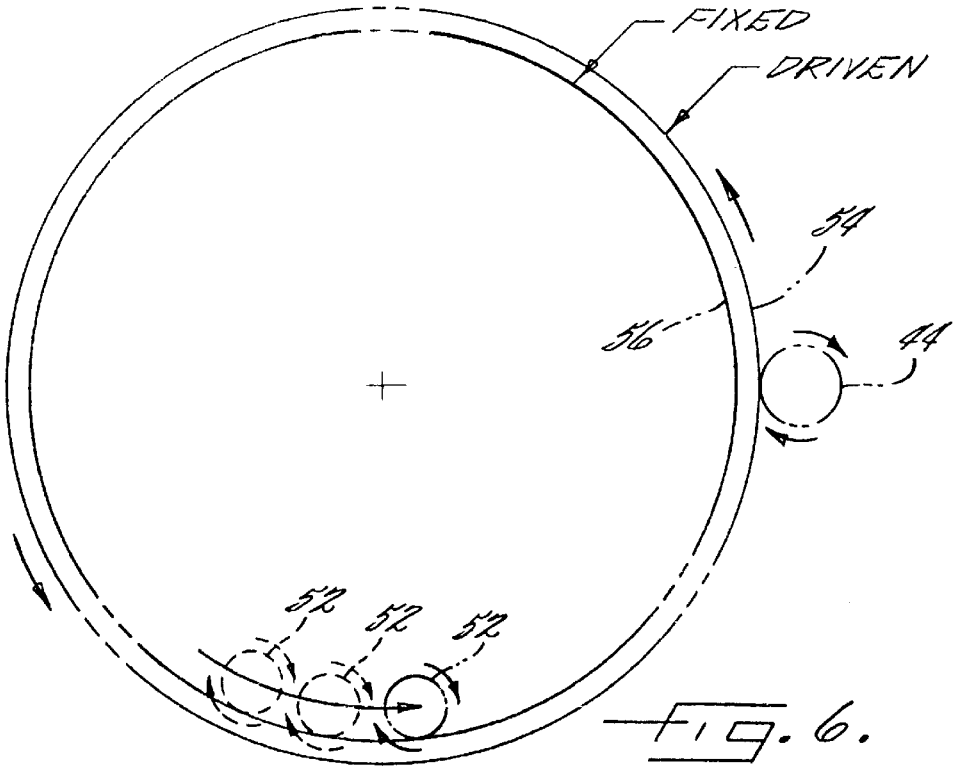
FIG. 6 is a further schematic illustration thereof in a different rotational position.

The torque resulting from this arrangement is illustrated schematically in FIGS. 5 and 6. The outer circumference of the takedown ring gear 50 is illustrated at 54 and the inner circumference of the stationary ring gear 48 is illustrated at 56. The lower drive pinion gear 44 is also schematically illustrated with rotational arrows representing its direction of rotation. As illustrated, the lower drive pinion gear 44 rotates in a clockwise direction which thereby rotates the takedown ring gear 50 in a counterclockwise direction. The counterclockwise direction of the takedown ring gear as represented by 56 thereby imparts rotational forces to the drive gear 52 of the drive unit 28 wherein the drive gear 52 rotates about its axis in a clockwise direction while moving in a counterclockwise direction as represented by the plurality of phantom drive gears. FIG. 6 represents further rotation of the takedown ring gear represented by 54 where the stationary ring gear represented by 56 remains fixed. As illustrated by a comparison of FIGS. 5 and 6, the roller drive pinion gear 44 mounted to the vertical shaft 26 does not rotate relative to the fixed stationary ring gear 48 but the drive gear 52 of the drive unit 28 rotates relative to the stationary ring gear 48.

As best illustrated in FIG. 3, the vertical shaft 26 of the knitting machine 10 is received within the frame 14 but is rotatably received therein. The lower drive pinion gear 44 is mounted to the lower portion of the vertical shaft 28 so as not to rotate relative thereto. An aperture 58 is defined by the stationary ring gear 48 to accommodate the vertical shaft 26 and the drive gear 44 for rotating the takedown assembly 20. A ball bearing 60 is provided on the frame 14 so as to contact the rotating takedown ring gear 50. As illustrated in FIG. 3, the takedown ring gear 50 is formed of a plurality of elements secured by a helical screw 62, but it would not be a departure from the present invention to provide a unitary structure for the takedown ring gear 50.

Figure 2:
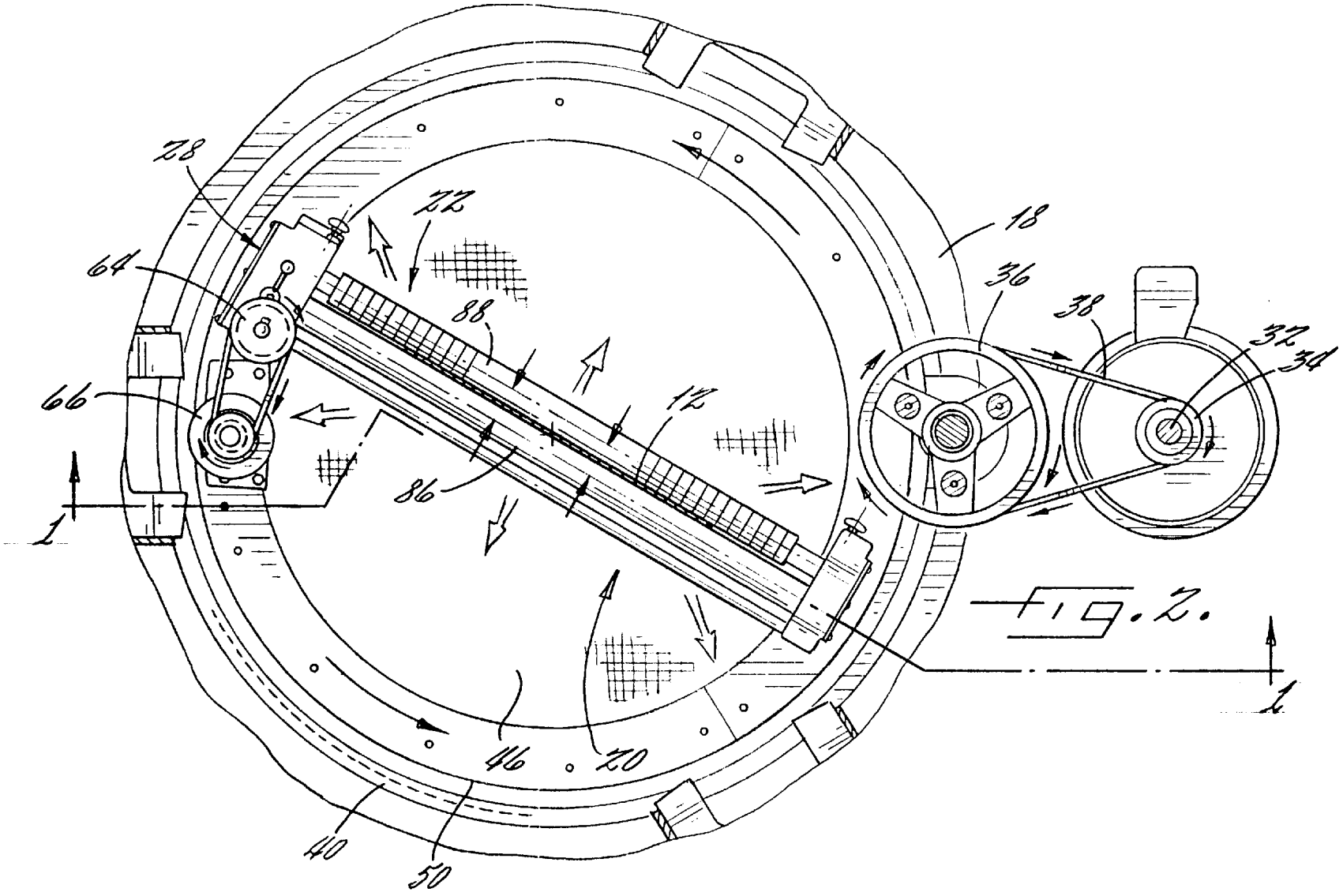
FIG. 2 is a cross-sectional view taken along line 2—2 of FIG. 1 illustrating a top plan view of the fabric receiving tub with the takedown assembly mounted thereon.
Figure 7:
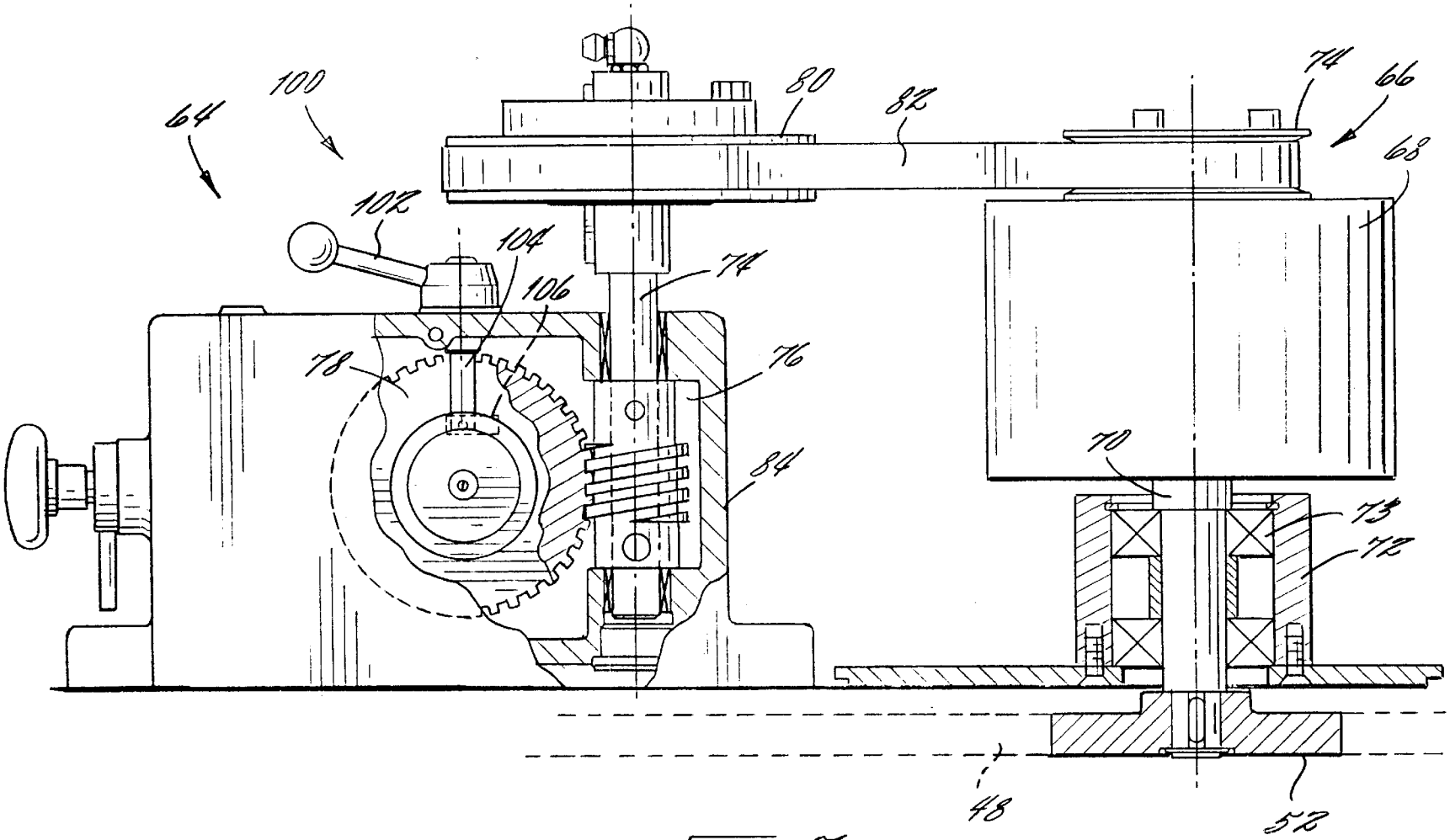
FIG. 7 is an enlarged side elevational view, partially broken away, of the drive unit of the takedown assembly.

The drive unit 28 of the takedown assembly 20 will now be described in further detail. As best illustrated in FIGS. 2 and 7, the takedown assembly 20 includes a roller assembly 22 and a drive unit 28. The drive unit 28 includes a drive assembly shown generally at 64 and a clutch assembly shown generally at 66. The drive unit 28 is fixedly mounted to an upper surface of the takedown ring gear 50 as illustrated wherein the roller assembly remains substantially horizontal. Accordingly, the pair of rollers 24 which depend from the drive unit 28 do not pivot relative to the upper surface of the takedown ring gear 50 to ensure consistent tension on the knitted fabric.

The clutch assembly 66 includes a slip coupling 68, a vertical transmission shaft 70, and a drive gear 52 mounted on the lower portion of the transmission shaft 70. A support 72 including bearings 73 is mounted to the takedown ring gear 50 to support the clutch assembly 66. Accordingly, as the takedown ring gear rotates, the clutch drive gear 52 rotates in an opposite position so as to transmit torque to the transmission shaft 70 of the clutch assembly 66. Mounted on an upper end of the transmission shaft 70 is a pulley 74 which is fixedly mounted to the vertical transmission shaft 70.

The drive assembly 64 includes a vertical transmission shaft 74 which supports fixedly thereon a first transmission gear 76, illustrated in FIG. 7 as a worm gear. The first transmission gear 76 is in an intersecting skew relationship with a second transmission gear, or a roller drive gear 78, which is illustrated as an external spur gear. As such, the intersecting skew relationship between the first transmission gear 76 and the roller drive gear 78 transmits torque from the vertical transmission shaft 74 to the vertically displaced roller drive gear 78.

A pulley 80 is mounted on an upper end of the transmission shaft 74 of the drive assembly 64. A belt 82 encircles the pulley 74 of the clutch assembly 66 and the pulley 80 of the drive assembly 64. Accordingly, rotational forces applied to the drive gear 52 of the clutch assembly 66 by the stationary ring gear 48 is transmitted via the pulleys 74 and 80 and the belt 82 to the vertical transmission shaft 74 of the drive assembly 64, thereby causing the roller drive gear 78 to rotate. A housing 84 encloses the gear mechanism of the drive assembly 74. The housing 84 is mounted to an upper surface of the takedown ring gear 50.

The takedown assembly 20 also includes the roller assembly 22 including at least a pair of rollers 24. The pair of rollers 24 illustrated includes a driver roller 86 and a driven roller 88. The driver roller 86 extends within the housing 84 of the drive assembly 64. The roller drive gear 78 is mounted to the end of the driver roller 86 extending within the housing 84. Accordingly, as torque is transmitted to the drive assembly 64, the first transmission means 76 transmits torque to the roller drive gear 78 which is fixedly mounted to the driver roller 86 thereby rotating the same.

Figure 10:
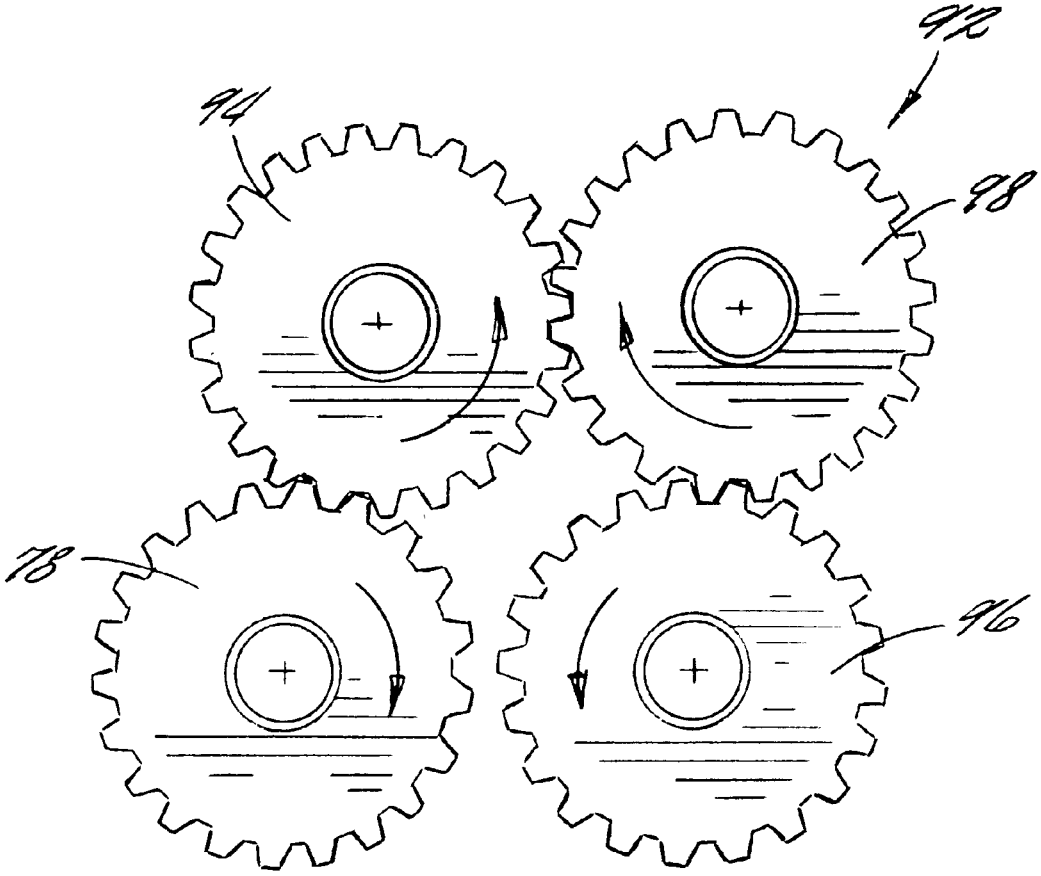
FIG. 10 is a schematic illustration of the torque transmitting members of the rollers of the takedown assembly.

Mounted at the opposite end of the driver roller 86 is a transmission gear assembly, indicated generally at 92 and schematically represented in FIG. 10, for driving the driven roller 88. The roller drive gear 78 rotates in a clockwise direction, for example, and meshes with a driver roller intermediate gear 94. The driven roller 88 has a driven roller gear 96 fixedly mounted at a respective end thereof. An intermediate driven roller gear 98 meshes with the driver roller intermediate gear 94 and rotates in the same direction as the roller drive gear 78. The intermediate driven roller gear 98 is geared with the driven roller gear 96.

Therefore, the driven roller gear 96 rotates in the direction opposites e.g., counterclockwise, the roller drive gear 78. The gear assembly 92 thereby provides torque to the driven roller 88 in a direction opposite the driver roller 86 so that the roller assembly 22 effectively applies tension to the formed fabric and draws it from the cylinder 16. The gear assembly 92 enables the driver roller 86 to drive the driven roller 88 while being spaced apart therefrom. It is within the scope of the invention to provide any number of gears within the gear assembly 92. For example two gears 78 and 96 may be provided without the intermediate gears 94, 98.

Accordingly, rotation of the first transmission means 76 thereby rotates the roller drive gear 78 of the driver roller thereby causing the driver roller to rotate about its axis which thereby rotates the driven roller via the transmission gear assembly 92. As illustrated, only the driver roller 86 is directly driven from the drive assembly 64. It would not be a departure form the scope of the present invention, however, for both rollers 86 and 88 to be driven by the drive assembly 64.

Preferably, the slip coupling 68 of the clutch assembly 66 is a magnetic slip coupling wherein a predetermined, substantially constant torque is applied to the rollers 86 and 88 due to magnetic forces. Accordingly, when an excessive load, i.e., when the rollers 86 and 88 are driven more rapidly than the desired rate relative to the rate that the knitted fabric 12 is being delivered by the rotating cylinder 16 and relative to a predetermined amount of tension applied to the fabric 12, then slippage is permitted by the slip coupling 68. Thus slippage accommodates variations between the rate of rotation of the roller drive gear 78 relative to the rotation of the takedown ring gear 50. When slippage occurs, the excessive load experienced by the drive assembly 64 is relaxed. Accordingly, constant torque is transmitted to the driver roller 86 wherein no slippage occurs between the rollers 24 and the fabric 12. The magnetic slip coupling 68 according to the illustrated embodiment is well known to one of ordinary skill in the art and is therefore not described in detail herein. A benefit of known magnetic clutches is that the predetermined parameters may be adjusted.

As illustrated, the motor 30 is directly cooperative with the cylinder ring gear 40 but it would not be a departure from the present invention for the motor 30 to be operatively associated with the takedown ring gear 50 via the lower drive pinion gear 44. Stated differently, it would not be a departure from the present invention for the pulley 34 of the motor to be associated with the lower drive pinion gear 44 via the belt 38 which would thereby drive the cylinder ring gear 40 due to its connection to the vertical drive shaft 26.

Figure 9:
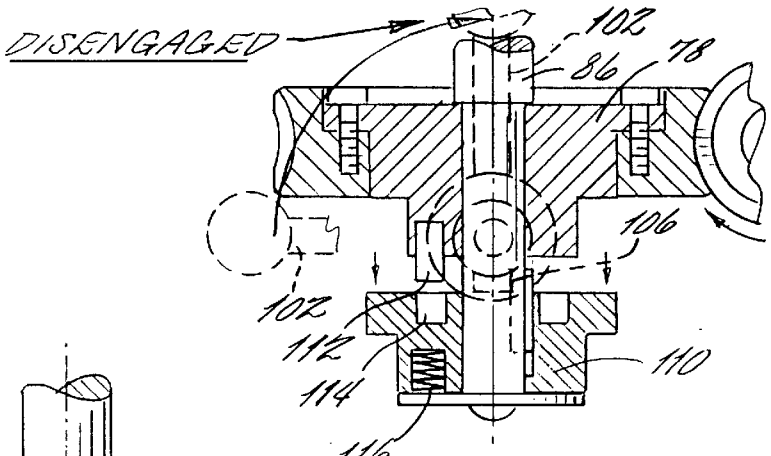
FIG. 9 is an enlarged view of a portion of FIG. 8 in a disengaged position.
Figure 8:
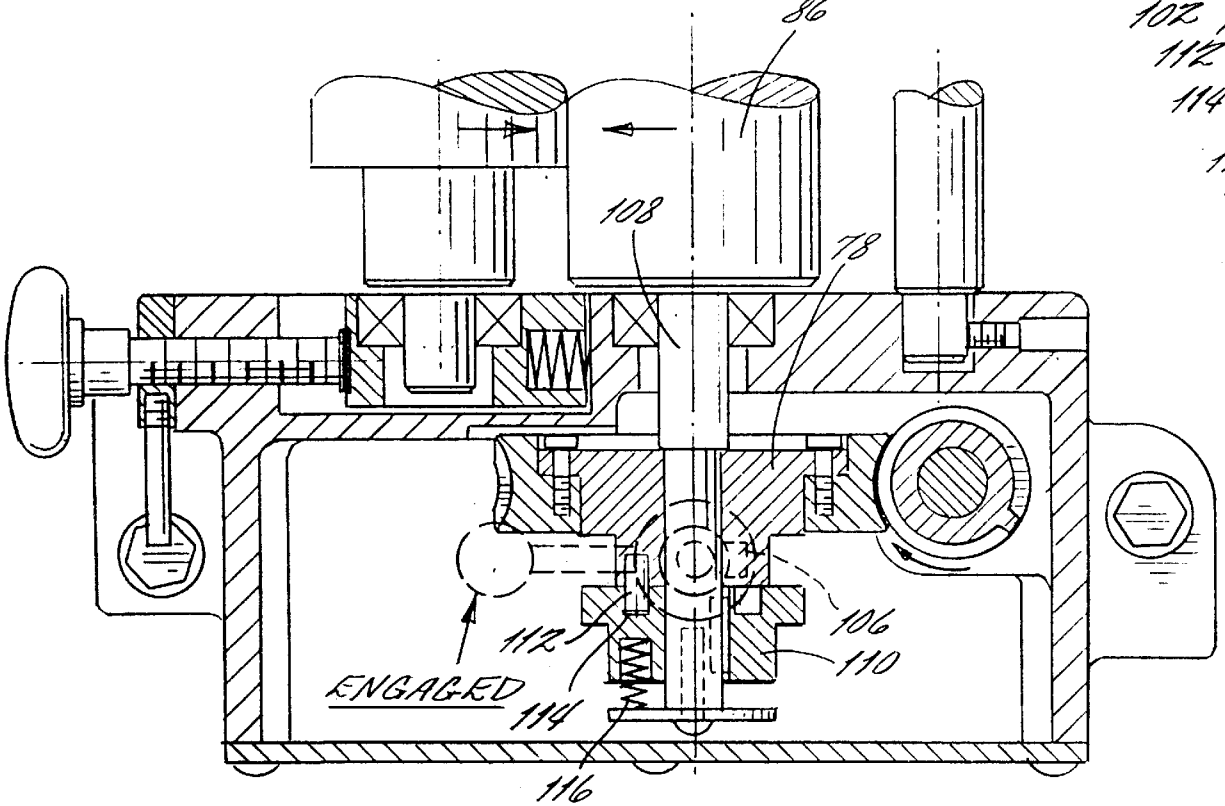
FIG. 8 is a cross-sectional view of FIG. 7 taken along line 8—8 illustrating an engaged position.

A disengagement assembly 100 is provided on the drive assembly 64. This is best illustrated in FIGS. 7, 8 and 9. The disengagement assembly 100 includes an actuating handle 102 which is fixedly mounted to a vertical shaft 104. The vertical shaft 104 includes an actuator 106 in the form of an extension extending perpendicular to the vertical shaft 104. In operation, when the actuating handle 102 is rotated about the vertical shaft 104, the actuator 106 disengages the driver roller 86 from engagement with the roller drive gear 78 wherein the driver roller 86 is permitted to rotate freely relative thereto.

More specifically, the driver roller 86 includes a spindle 108 extending from a respective end wherein the spindle extends within the drive assembly housing 84 and extends through the roller drive gear 78 and also through an end cap 110. The roller drive gear 78 includes a pin 112 which mates with a channel 114 of the end cap 110. The end cap 110 is fixedly mounted to the spindle 108 of the driver roller 86. Biasing means 116, as shown in the form of a spring, urge the end cap 110 into locking engagement with the roller drive gear 78 wherein when the roller drive gear 78 rotates, the driver roller 86 likewise rotates. This represents the engaged position as shown in FIG. 8.

When the actuating handle 102 is rotated, e.g., 90°, the actuator 106 urges against the cap 110 urging it away from the roller drive gear 78 against the bias of the spring 118. As such, the pin 112 is removed from the channel 114 wherein even if the motor 30 is actuated so as to drive the takedown assembly 20, the spindle 108 of the driver roller 86 is disengaged from the roller drive gear 78 wherein the driver roller 86 is no longer driven by the takedown assembly 20. As such, the driver roller 86 and the driven roller 88 are freely rotatable manually. This arrangement enables proper positioning of the fabric within the roller assembly 22 and accommodates any slack formed in the fabric. When the actuating handle 102 is rotated 90° again, the cap 110 again is urged into alignment with the pin 112 of the roller drive gear 78 wherein the drive assembly 64 is again in an engaged position as represented by FIG. 8. Of course, due to the bias arrangement of the cap 110, full rotation of the actuating handle 102 is likely unnecessary since it is urged toward its engaged position.

While particular embodiments of the invention have been described, it will be understood, of course, the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

That which is claimed:

1. A circular knitting machine for forming fabric of various weights, said machine comprising:

a stationary frame supporting at its upper end a rotating knitting cylinder for forming a tubular knitted fabric and delivering it in a hanging state;

a fabric receiving tub mounted to a lower end of said frame and having a fabric receiving aperture at an upper end thereof circumscribed by a stationary ring gear;

a vertical shaft connecting said knitting cylinder to said fabric receiving tub;

a takedown assembly for applying tension to the fabric suspended from said knitting cylinder, said takedown assembly comprising a takedown ring gear which cooperates with said vertical shaft to rotate synchronously with said knitting cylinder, a drive unit fixedly mounted to said takedown ring gear and comprising a clutch assembly and a drive assembly, said clutch assembly comprising a magnetic slip coupling, a clutch drive gear and a transmission shaft wherein said clutch drive gear cooperates with said stationary ring gear to transmit torque to said transmission shaft, said drive unit comprising a first transmission gear wherein torque is transmitted from said transmission shaft of said clutch assembly to said first transmission gear, said drive unit also comprising a second transmission gear for transmitting torque from said clutch assembly, a roller assembly mounted to said takedown ring gear and associated with said drive unit and including a roller drive gear for receiving transmitted torque from said second transmission gear of said drive assembly, said roller assembly comprising at least a pair of rollers for applying tension to the formed fabric wherein at least one of said rollers is driven by said roller drive gear wherein said takedown assembly provides constant torque transmission to the at least one pair of rollers for applying a predetermined, substantially constant tension to the formed fabric wherein when excessive load is applied to the at least one pair of rollers, the drive unit including the clutch assembly applies constant torque to said roller assembly to provide a desired amount of tension to the formed fabric.

2. A circular knitting machine according to claim 1 wherein said roller assembly is mounted to an upper surface of said takedown ring gear.

3. A circular knitting machine according to claim 1 wherein said drive unit is mounted to an upper surface of said takedown ring gear.

4. A circular knitting machine according to claim 1 wherein said knitting cylinder includes a cylinder ring gear which cooperates with said vertical shaft for transmitting torque from said knitting cylinder to said takedown assembly.

5. A circular knitting machine according to claim 4 wherein said vertical shaft includes an upper drive pinion for cooperating with said cylinder ring gear.

6. A circular knitting machine according to claim 4 wherein said vertical shaft includes a lower drive pinion for rotating said takedown ring gear to directly transmit torque from the rotating knitting cylinder.

7. A circular knitting machine according to claim 6 comprising a motor associated with said cylinder ring gear.

8. A circular knitting machine according to claim 6 comprising a motor associated with said takedown ring gear.

9. A circular knitting machine according to claim 1 wherein said drive gear of said clutch unit directly cooperates with said stationary ring gear of said fabric receiving tub and said transmission shaft of said clutch unit to directly transmit torque from the stationary ring gear of said fabric receiving tub.

10. A circular knitting machine according to claim 1 wherein said at least a pair of rollers includes a driver roller which cooperates with said roller drive gear.

11. A circular knitting machine according to claim 10 wherein said at least a pair of rollers also includes a driven roller which includes a transmission gear which cooperates with a respective transmission gear of said driver roller wherein said transmission gears are positioned on a respective end of said rollers opposite said drive unit.

12. A circular knitting machine according to claim 1 wherein said takedown assembly further includes a disengagement assembly for disengaging said at least one pair of rollers from said drive assembly.

13. A takedown assembly for a circular knitting machine for forming knitted fabric wherein the takedown assembly applies tension to the formed fabric suspended from a knitting cylinder of the circular knitting machine and delivers the fabric through a fabric receiving aperture at an upper end of a fabric receiving tub, said takedown assembly comprising:

a takedown ring gear for rotating said takedown assembly, said takedown ring gear adapted to circumscribe the fabric receiving aperture of the fabric receiving tub;

a drive unit mounted to said takedown ring gear such that said drive unit is adapted to be disposed substantially above the upper end of the fabric receiving tub and comprising a clutch assembly and a drive assembly, said clutch assembly comprising a slip coupling, a clutch drive gear and a transmission shaft wherein said clutch drive gear is mounted so as to transmit torque to said transmission shaft, said drive assembly comprising a first transmission gear wherein torque is transmitted from said transmission shaft of said clutch assembly to said first transmission gear, a second transmission gear for transmitting torque from said first transmission gear, and a roller assembly mounted to said takedown ring gear and associated with said drive unit and including a roller drive gear for receiving transmitted torque from said second transmission gear of said drive assembly, said roller assembly being disposed above said takedown ring gear and comprising at least one pair of rollers for applying tension to the formed fabric wherein at least one roller of said at least one pair of rollers is driven by said roller drive gear wherein said takedown assembly provides constant torque transmission on the at least one pair of rollers for applying tension to the formed fabric wherein, when excessive load is applied to the at least one pair of rollers, the drive unit including the clutch assembly applies constant torque to said roller assembly to provide a desired amount of tension to the formed fabric.

14. A takedown assembly according to claim 13 wherein said transmission shaft of said drive unit is in an intersecting skew relationship with said roller drive gear for transmitting torque to said at least one pair of rollers.

15. A takedown assembly according to claim 14 wherein said transmission shaft is a worm gear.

16. A takedown assembly according to claim 15 wherein said at least one pair of rollers also includes a driven roller which includes a transmission gear associated with a respective transmission gear of said driver roller wherein said transmission gears are positioned on a respective end of said rollers opposite said driver unit.

17. A takedown assembly according to claim 14 wherein said drive unit further comprises a clutch pulley mounted to said clutch assembly and a drive pulley mounted to said transmission shaft of said driver assembly and a transmission belt connected to said pulleys for transmitting torque from said clutch assembly to said drive assembly.

18. A takedown assembly according to claim 13 wherein said drive unit further comprises a disengagement arrangement for disengaging said at least one pair of rollers from cooperating with said drive gear of said drive assembly.

19. A takedown assembly according to claim 18 wherein said disengagement arrangement is operable to render said at least one pair of rollers rotatable relative to said roller drive gear.

20. A takedown assembly according to claim 13 wherein said clutch assembly includes adjustable predetermined load settings.

21. A takedown assembly according to claim 13 comprising a motor associated with said takedown ring gear.

* * * * *

UNITED STATES PATENT AND TRADEMARK OFFICE
CERTIFICATE OF CORRECTION

PATENT NO. : 6,016,670

DATED : January 25, 2000

INVENTOR(S) : Kuhrau et al.

It is certified that error appears in the above-identified patent and that said Letters Patent is hereby corrected as shown below:

Title page, item [54], line 2 and Column 1, line 2:

In the title, after "CONSTANT" insert --TENSION--.

Title page, item [75], in the second inventor's address, "Jamesville" should read --Janesville--.

Title page, insert the following:

--[60] Provisional application No.60/022,077 July 29, 1996--

Column 1,line 6 insert the following:
--CROSS REFFERENCE TO RELATED APPLICATION
Reference is made to and priority claimed from U.S. provisional application Ser. No.60/022,077, filed July 29, 1996--.

Signed and Sealed this

Second Day of January, 2001

*Attest:*

Q. TODD DICKINSON

*Attesting Officer*

*Commissioner of Patents and Trademarks*